US005701796A

United States Patent [19]

Takano et al.

[11] Patent Number: 5,701,796

[45] Date of Patent: Dec. 30, 1997

[54] HYDRAULIC APPARATUS FOR TRAVELING

[75] Inventors: Toshiro Takano; Mitsumasa Akashi, both of Tochigi-ken, Japan

[73] Assignee: Komatsu Ltd., Tokyo, Japan

[21] Appl. No.: 687,444

[22] PCT Filed: Feb. 28, 1995

[86] PCT No.: PCT/JP95/00317

§ 371 Date: Aug. 14, 1996

§ 102(e) Date: Aug. 14, 1996

[87] PCT Pub. No.: WO95/23260

PCT Pub. Date: Aug. 31, 1995

[30] Foreign Application Priority Data

Feb. 28, 1994 [JP] Japan ..... 6-028713

[51] Int. Cl.[6] ..... F15B 11/00

[52] U.S. Cl. ..... 91/512; 91/530

[58] Field of Search ..... 91/508, 512, 530, 91/525

[56] References Cited

U.S. PATENT DOCUMENTS

| | | | |
|---|---|---|---|
| 4,149,565 | 4/1979 | Jennings et al. | 91/508 X |
| 4,166,506 | 9/1979 | Tezuka et al. | 91/512 X |
| 4,489,644 | 12/1984 | Tsukimoto et al. . | |
| 4,534,268 | 8/1985 | Yagyu et al. | 91/530 X |
| 4,557,291 | 12/1985 | Hashimoto | 91/530 X |

FOREIGN PATENT DOCUMENTS

| | | |
|---|---|---|
| 2-212605 | 8/1990 | Japan . |
| 4-131504 | 5/1992 | Japan . |
| 4-244604 | 9/1992 | Japan . |
| 5-1432 | 1/1993 | Japan . |

*Primary Examiner*—Hoang Nguyen

*Attorney, Agent, or Firm*—Nikaido, Marmelstein, Murray & Oram LLP

[57] ABSTRACT

In a hydraulic apparatus for traveling, a left direction switching valve is formed by forming a spool bore having a pump port, an actuator port and a return port in a first valve block, and by disposing a spool within the spool bore for establishing and blocking communication of respective of the ports to another of the ports, a right direction switching valve is formed by forming a spool bore having a pump port, an actuator port and a return port in a second valve block, and by disposing a spool within the spool bore for establishing and blocking communication of respective of the ports to another of the ports, and a switching valve is formed by forming a spool bore having a primary port and a drain port in a third valve block, and by disposing a spool within the spool bore for establishing and blocking communication between respective of the ports and another of the ports. The first and second valve blocks are respectively connected with the third valve block to communicate respective of the return ports and the drain port.

5 Claims, 7 Drawing Sheets

HYDRAULIC APPARATUS FOR TRAVELING

FIELD OF THE INVENTION

The present invention relates to a hydraulic apparatus for traveling for driving a crawler type working vehicle, such as a power shovel and so forth by supplying a pressurized fluid discharged from one hydraulic pump to left and right hydraulic motors for traveling.

BACKGROUND ART

As a power shovel, there has been known a crawler type one, in which a vehicle body is provided on a traveling body for turning by turning hydraulic motors, a boom, an arm and a bucket are provided on the vehicle body for pivotal movement in vertical direction by means of a boom cylinder, an arm cylinder and a bucket cylinder, and left and right crawlers provided on the traveling body are driven by respective of left and right hydraulic motors for traveling.

As a hydraulic circuit for supplying a pressurized fluid discharged from one hydraulic pump to respective hydraulic actuators of such power shovel, there has been known one hydraulic circuit disclosed in Japanese Unexamined Patent Publication (Kokai) No. Heisei 4-244604, for example. The disclosed circuit is constructed with one variable displacement hydraulic pump which displacement is controlled so that a pressure difference between a load pressure of a hydraulic actuator and a discharge pressure of the pump becomes constant, a plurality of direction switching valves connected to discharge side of the variable displacement hydraulic pump to be supplied pressurized fluid to respective hydraulic actuators, and a plurality of pressure compensation valves, each being constructed with a load check valve provided at the inlet side of each direction switching valve and a pressure reduction valve pushing the load check valve in a closing direction by a downstream pressure against each load pressure.

When the hydraulic circuit for traveling is constructed with the hydraulic circuit as set forth above, the hydraulic circuit becomes as shown in FIG. 1, for example. Namely, left and right direction switching valves 5 and 6 are provided in a discharge passage 2 of the variable displacement hydraulic pump 1 for supplying pressurized fluid to left and right hydraulic motors 3 and 4 for traveling. At inlet sides of the left and right direction switching valves 5 and 6, pressure compensation valves 9, each is constructed with each load check valve 7 and a pressure reduction valve 8 pushing the load check valve 7 in closing direction by a downstream pressure against each load pressure, are provided. Then, respective load pressure detecting ports 5*a* and 6*a* of the left and right direction switching valves 5 and 6 are respectively connected to the pressure reduction valve 8 of the respective pressure compensation valve 9. A downstream pressure of the pressure reduction valve 8 is supplied to a displacement control valve 11 via a load pressure introduction passage 10 for controlling the displacement of the variable displacement hydraulic pump 1 by a displacement control cylinder 12 so that a pressure difference between the load pressure and the discharge pressure of the pump becomes constant. Furthermore, with respective pressure compensation valves 9, a meter-in pressure difference of the left and right direction switching valves 5 and 6 is controlled to be constant. It should be noted that 13 denotes a counter-balance valve.

In such hydraulic circuit, left and right turning traveling is performed by differentiating revolution speeds of the left and right hydraulic motors 3 and 4 for traveling by differentiating meter-in open areas of the left and right direction switching valves 5 and 6 by means of an operation lever 15 or so forth. However, at this time, traveling speed is lowered.

Namely, since turning resistance becomes large during left and right turning traveling, the hydraulic motor for traveling located at the inner side of turning circle which revolution speed is lower, becomes braking state to make driving pressure zero (or set pressure of the counter-balance valve). On the other hand, the driving pressure of the hydraulic motor for traveling located at the outer side of turning circle, which revolution speed is higher, becomes high pressure corresponding to traveling resistance and turning resistance.

Therefore, a pressure difference between the hydraulic motor for traveling at the inner side of turning circle and the hydraulic motor for traveling at the outer side of turning circle becomes large. Flow of the pressurized fluid to the hydraulic motor for traveling at the inner side of turning circle causes energy loss to make the pump discharge pressure and the load pressure high pressure. Accordingly, in such crawler type working vehicle, since the driving horse power of the hydraulic pump is typically controlled to be constant, the displacement of the variable displacement hydraulic pump is lowered to cause lowering of the traveling speed due to reduction of flow rate to the hydraulic motor for traveling at the outer side of turning circle.

Namely, for example, upon turning traveling toward an arrow a with setting the left hydraulic motor 3 for traveling at the outer side of the turning circle and setting the right hydraulic motor 4 for traveling at the inner side of the turning circle by setting the left and right direction switching valves 5 and 6 at right side positions A, setting a meter-in opening area of the left side direction switching valve 5 large and setting a meter-in opening area of the right side direction switching valve 6 significantly small, the right hydraulic motor 4 for traveling becomes braking condition to set a driving pressure PL2 at a set pressure of the counter-balance valve 13, and the left hydraulic motor 3 for traveling is set a driving pressure PL1 at high pressure corresponding to the traveling resistance and the turning resistance. Therefore, the pressure reduction valve 8 of the pressure compensation valve 9 relating to the outer side of the turning circle is pushed toward right by a load pressure PL1 to make the open degree of the load check valve 7 large, and the pressure reduction valve 8 of the pressure compensation valve 9 relating to the inner side of the turning circle is pushed toward left by the load pressure PL1 relating to the outer side of the turning circle to push the load check valve 7 toward closing side to make the open degree of the load check valve 7 smaller. The open degree of the load check valve 7 is inversely proportional to the pressure difference between the driving pressures (PL1–PL2).

Therefore, when the meter-in open area of the right side direction switching valve 6 is significantly small, then the pressure difference (PL1–PL2) is large, the discharge pressure of the variable displacement hydraulic pump 1 becomes large. In conjunction therewith, the control for constant horse power becomes active to reduce the displacement of the hydraulic pump 1. Thus, the flow rate of the pressurized fluid flowing into the hydraulic motor for traveling at the outer side of the turning circle is reduced to cause lowering of traveling speed upon turning traveling.

Therefore, the applicant has proposed a hydraulic circuit for traveling which can solve the problems set for above, and which the content of the proposal has already been published as Japanese Unexamined Patent Publication No. Hei 6-241203.

Namely, as shown in FIG. 2, return circuits 21 and 22 of the left and right side direction switching valves 5 and 6 are provided to perform control of establishing and blocking connections of the return circuits 21 and 22 to an auxiliary relief valve 24 and a tank 25 by the switching valve 23. Furthermore, the inlet side of the auxiliary relief valve 24 is connected to upstream side circuits 28 and 29 of the left and right direction switching valves 5 and 6 via the a circuit 26 and a check valve 27.

The switching valve 23 is held at a drain position B by a spring force, and is switched between a left position C and a right position D with the pressurized fluid supplied to left and right pressure receiving portions 30 and 31.

First and second circuits 42 and 43 of left and right pilot valves 40 and 41 for switching the left and right direction switching valves 5 and 6 are connected to left and right circuits 45 and 46 via shuttle valve 44 as high pressure preferential valve. The left and right circuits 45 and 46 are connected to the left and right pressure receiving portions 30 and 31 of the switching valve 23. Thus, the switching valve 23 is switched by utilizing the pilot pressurized fluid from the left and right pilot valves 40 and 41 for switching the left and right direction switching valves 5 and 6.

With such hydraulic circuit for traveling, the outputs of the left and right pilot valves 40 and 41 are taken as forward movement side outputs to place the left and right direction switching valves 5 and 6 at forward movement position A, and the output pressure of the left pilot valve 40 is set to be higher than the output pressure of the right pilot valve 41 to make the meter-in opening area of the left direction switching valve 5 large and to make the meter-in opening area of the right direction switching valve 6 small to apply the left hydraulic motor 3 for traveling at outer side of the turning circle and the right hydraulic motor 4 for traveling at inner side of the turning circle to cause turning traveling in the direction of arrow a. In this case, the right hydraulic motor 4 for traveling gets in braking condition to set the driving pressure PL2 at the set pressure of the counter-balance valve 13. The driving pressure PL1 for the left hydraulic motor 3 for traveling is set at high pressure corresponding to the traveling resistance and turning resistance. Thus, the inlet pressure P1 of the left direction switching valve 5 becomes higher than the inlet pressure P2 of the right direction switching valve 6.

On the other hand, the pilot pressure of the left circuit 45 is higher than the pilot pressure of the right circuit 46. Thus, the switching valve 23 is placed at the left position C by the pressure of the left pressure receiving portion 30. Accordingly, the return circuit 21 of the left direction switching valve 5 is connected to the inlet side of the auxiliary relief valve 24 to elevate the pressure at the inlet side of the auxiliary relief valve 24 to the set pressure P3. The pressurized fluid in the auxiliary relief valve flows into the upstream side circuit 29 of the right direction switching valve 6 via the circuit 26 and the check valve 27. It should be noted that the return circuit 22 of the right direction switching valve 6 is connected to the tank 25 so that the pressurized fluid directly flows to the tank 25.

By this, the load check valve 7 relating to the inside of the turning circle is pushed toward closure side to reduce the open area. Thus, the flow rate of the pressurized fluid flowing into the right hydraulic motor 4 for traveling from the variable displacement hydraulic pump 1 via the load check valve 7 is reduced.

Accordingly, the most part of the discharged pressurized fluid of the variable displacement hydraulic pump 1 is supplied to the left hydraulic motor 3 for traveling. Thus, even though the lowering of the displacement of the variable displacement hydraulic pump 1 is caused by horse power constant control, the flow rate of the pressurized fluid for the left hydraulic motor 3 for traveling at the outer side of turning circle is not reduced. Therefore, the vehicle speed is not lowered.

On the other hand, when such hydraulic circuit for traveling is constructed as the concrete hydraulic apparatus for traveling, the return circuits 21 and 22 of the left and right direction switching valves 5 and 6 and the switching valve 23 are connected by piping and the switching valve 23 is required to connect the tank 25 via piping. Therefore, the piping work becomes cumbersome.

On the other hand, in case of the hydraulic power shovel, if the piping construction is simplified with a construction where the switching valve 23 and the shuttle valve 44 outputting the signal for switching the former or the switching valve 23 are arranged within a narrow space between the blocks of the direction switching valves 5 and 6, the returning circuits 21 and 22 of the hydraulic circuit for traveling become common to the return circuit of the driving circuit for other work implement boom or arm. The work implement boom or arm can easily influenced by back pressure when other work implement boom or arm is driven.

The present invention has been worked for improvement the drawbacks set forth above. Thus, it is an object of the present invention to provide a hydraulic apparatus for traveling which is not influenced by the back pressure even when other work implement boom or arm is driven.

DISCLOSURE OF THE INVENTION

In order to accomplish the objects set forth above, there is provided according to the one aspect of the invention, a hydraulic apparatus for traveling comprising:

a left direction switching valve formed by forming a spool bore having a pump port, an actuator port and a return port in a first valve block, and by disposing a spool within the spool bore for establishing and blocking communication of respective of the ports to another of the ports;

a right direction switching valve formed by forming a spool bore having a pump port, an actuator port and a return port in a second valve block, and by disposing a spool within the spool bore for establishing and blocking communication of respective of the ports to another of the ports;

a switching valve formed by forming a spool bore having a primary port and a drain port in a third valve block, and by disposing a spool within the spool bore for establishing and blocking communication between respective of the ports and another of the ports; and the first and second valve blocks being respectively connected with the third valve block to communicate respective of the return ports and the drain port.

With the construction set forth above, the return fluids of the left and right hydraulic motors for traveling are directly flow in the first and second drain ports of the switching valve from respective return ports of the left and right direction switching valves to flow into the primary port or into the tank. Therefore, it is not necessary to connect the left and right direction switching valves and to the switching valve by piping, and to connect the switching valve to the tank by the piping. This facilitates piping operation.

According to another aspect of the invention, there is provided a hydraulic apparatus for traveling comprising:

a left direction switching valve formed by forming a spool bore having a pump port, an actuator port and a return port in a first valve block, and by disposing a spool within the spool bore for establishing and blocking communication of respective of the ports to another of the ports;

a right direction switching valve formed by forming a spool bore having a pump port, an actuator port and a return port in a second valve block, and by disposing a spool within the spool bore for establishing and blocking communication of respective of the ports to another of the ports;

a switching valve formed by forming a spool bore having a primary port and a drain port, and a suction port in a third valve block, and by disposing a spool within the spool bore for establishing and blocking communication between respective of the ports and another of the ports, the primary port being communicated with the drain port via a relief valve, and the primary port being communicated with the suction port via a check valve; and the first and second valve blocks being respectively connected with the third valve block to communicate for respective of the return ports and the drain port and to communicate the suction port to respective of the pump ports.

In addition to the construction set forth above, it is desirable to further comprise a tank port different from the return port in each of the first and second valve blocks, and a tank port different from the drain port in the third valve block, and these tank ports are communicated to each other.

With this construction, since the tank port is provided separately from the return port and the drain port, when an another direction switch valve for operating an another actuator is connected with the direction switching valve, even when the direction switching valve is operated, it may not be influenced by the return back pressure of another actuator to permit independently flow out the return fluid of the left and right hydraulic motors for traveling to the tank or to cause regeneration of the fluid.

In further addition to the construction set forth above, it is desirable that the spools of the left and right direction switching valves are actuated for switching by the pressurized fluid of the pressure receiving chambers provided at both sides of the spool, and the spool of the switching valve is actuated for switching by the pressurized fluid of the pressure receiving chamber provided at both sides of the spool, and the pressure receiving chambers of the left and right direction switching valves are communicated with the pressure receiving chamber of the switching valve via a shuttle valve.

With this construction, the switching valve may be switched by utilizing the pilot pressure for switching the left and right direction switching valves, and the piping for introducing the pilot pressure becomes unnecessary.

In the concrete aspect of the present invention, there is provided a hydraulic apparatus for traveling comprising:

a left direction switching valve for supplying a pressurized fluid to a left hydraulic motor for traveling comprising, and a spool bore having a pump port and two actuator ports and two return ports being formed in a first valve block, and a spool disposed within the spool bore being shifted to a backward movement position, in which the pump port and one of the actuator ports are communicated and the other of the actuator ports and the other of the return ports are communicated, by a pressurized fluid to a left pressure receiving chamber located at a left end side, and to a forward movement position, in which the pump port and the other of actuator ports are communicated and the one of actuator ports and one of the return ports are communicated, by a pressurized fluid to a right pressure receiving chamber at a right end side;

a right direction switching valve for supplying a pressurized fluid to a right hydraulic motor for traveling comprising, a spool bore having a pump port and two actuator ports and two return ports being formed in a second valve block, and a spool disposed within the spool bore being shifted to a forward movement position, in which the pump port and the other of the actuator ports are communicated and one of the actuator ports and one of the return ports are communicated, by a pressurized fluid to a left pressure receiving chamber located at a left end side, and to a backward movement position, in which the pump port and the one of the actuator ports are communicated and the other of the actuator ports and the other of return ports are communicated, by a pressurized fluid to a right pressure receiving chamber at a right end side;

a switching valve being formed with a spool bore having a primary port and first and second drain ports in a third valve block, and a spool disposed in the spool bore being shifted to a right position, in which the primary port and the second drain port are communicated by a pressurized fluid to a left pressure receiving chamber positioned at a left end side, and to a left position, in which the primary port and the first drain port are communicated by a pressurized fluid to a right pressure receiving chamber at a right end side; and wherein:

the first and second valve blocks being connected with the third valve block for communicating the first drain port with respective one of return ports and communicating the second drain port with respective other of the return ports; and the left pressure receiving chambers of the left and right direction switching valves being communicated with the left pressure receiving chamber of the switching valve via a left shuttle valve and the right pressure chambers of the left and right direction switching valves being communicated with the right pressure receiving chamber of the switching valve via a right shuttle valve.

With the construction set forth above, the left direction switching valve can be switched between backward and forward movement positions by the pressurized fluid to the left and right pressure receiving chambers, and the right direction switching valve can be switched between forward and backward movement positions by the pressurized fluid to the left and right pressure receiving chambers. Also, by communicating the left pressure receiving chambers of the left and right direction switching valves and the left pressure receiving chamber of the switching valve via the left shuttle valve, and communicating the right pressure receiving chambers of the left and right direction switching valves and the right pressure receiving chamber of the switching valve via the right shuttle valve. Thus, the switching valve is switched to left and right positions depending upon switching of the left and right direction switching valves.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

BEST MODE FOR IMPLEMENTING THE INVENTION

The preferred embodiment of a hydraulic apparatus for traveling according to the present invention will be discussed hereinafter with reference to the accompanying drawings.

Figure 1:
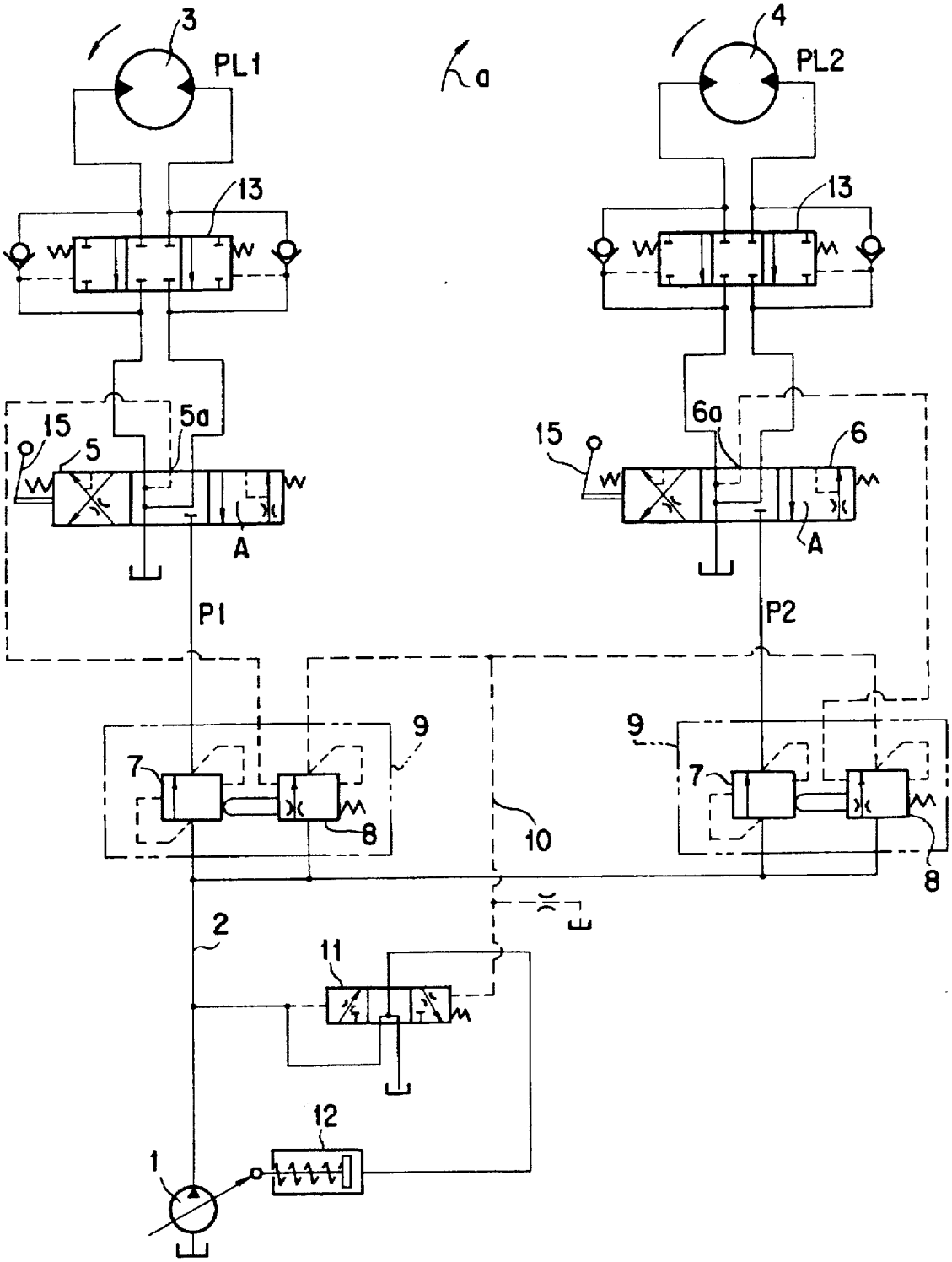
FIG. 1 PRIOR ART
FIG. 1 is an illustration showing the conventional hydraulic circuit for traveling.

One embodiment of the present invention will be discussed with reference to FIGS. 3 to 7. It should be noted that like elements to the prior art shown in FIGS. 1 and 2 will be identified by like reference numerals and detailed discussion therefor will be neglected.

Figure 3:
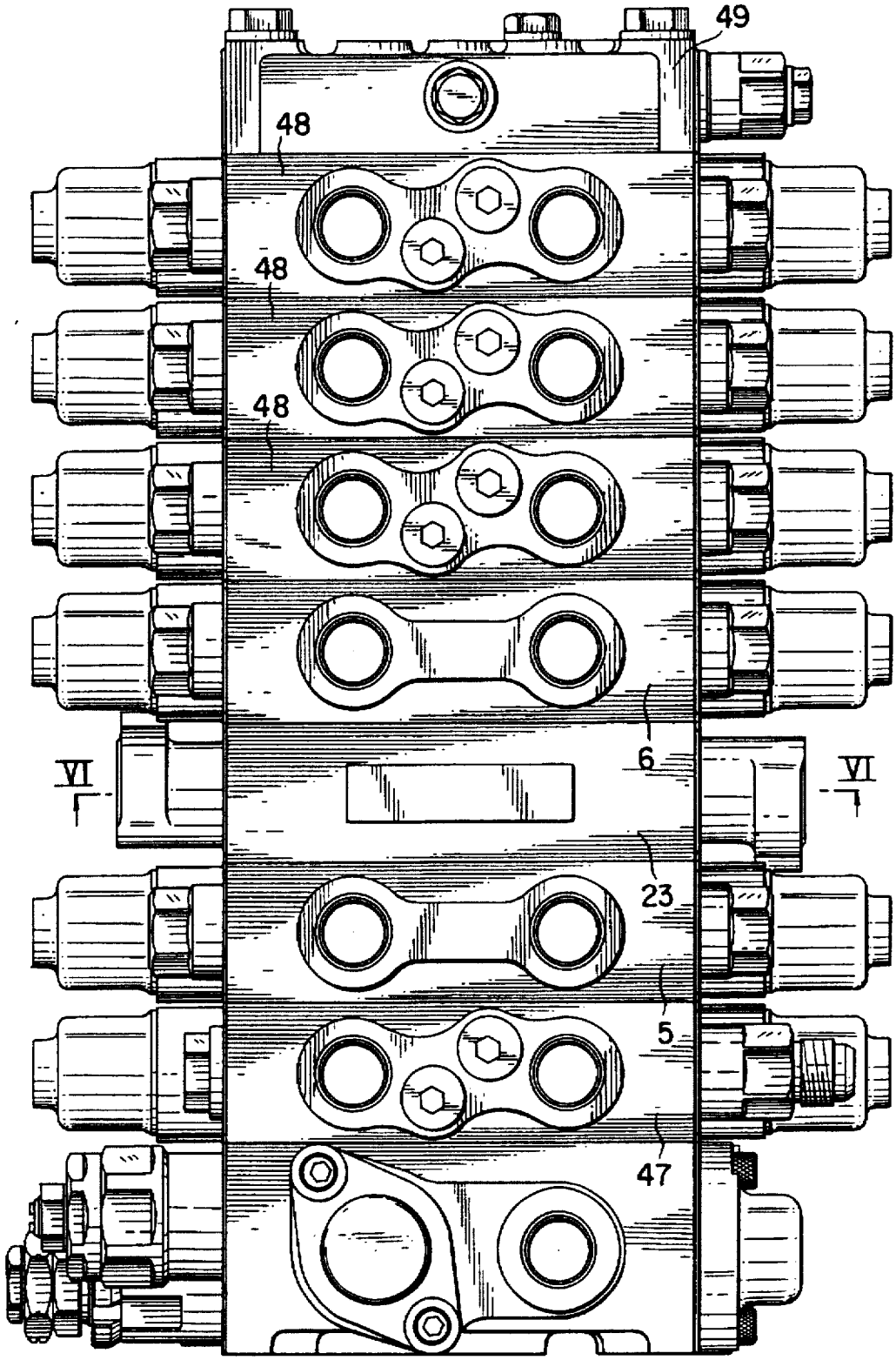
FIG. 3 is a front elevation of one embodiment of a hydraulic circuit for traveling according to the present invention.
Figure 4:
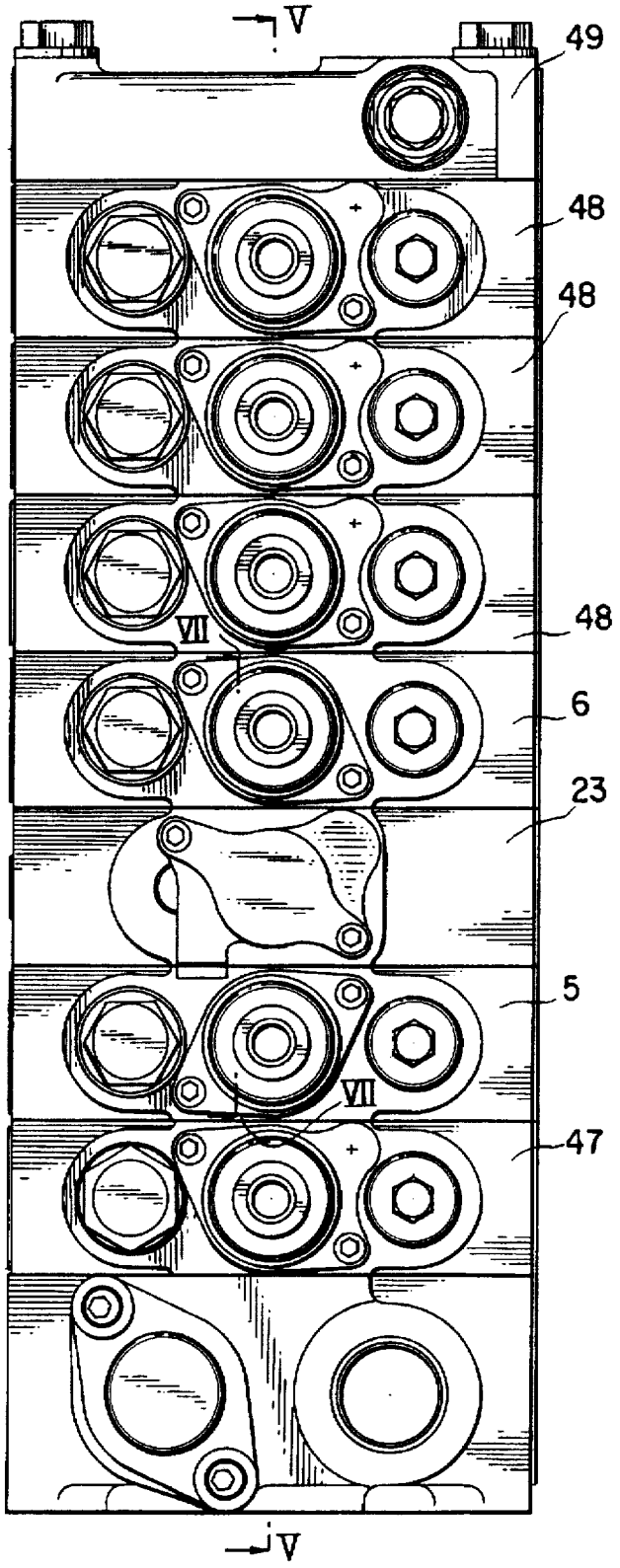
FIG. 4 is a right side elevation of the above-mentioned embodiment.

As shown in FIGS. 3 and 4, one direction switching valve unit is constructed by stacking and coupling a valve block of the switching valve 23 between a valve block of the left direction switching valve 5 and a valve block of the right direction switching valve 6, coupling a valve block of a direction switching valve 47 for turning to the left direction switching valve 5, stacking and coupling respective direction switching valves 48 for a boom, an arm and a bucket to the valve block of the right direction switching valve 6 in order, and coupling a block 49 to the valve block of the direction switching valve 48 for the bucket.

Figure 5:
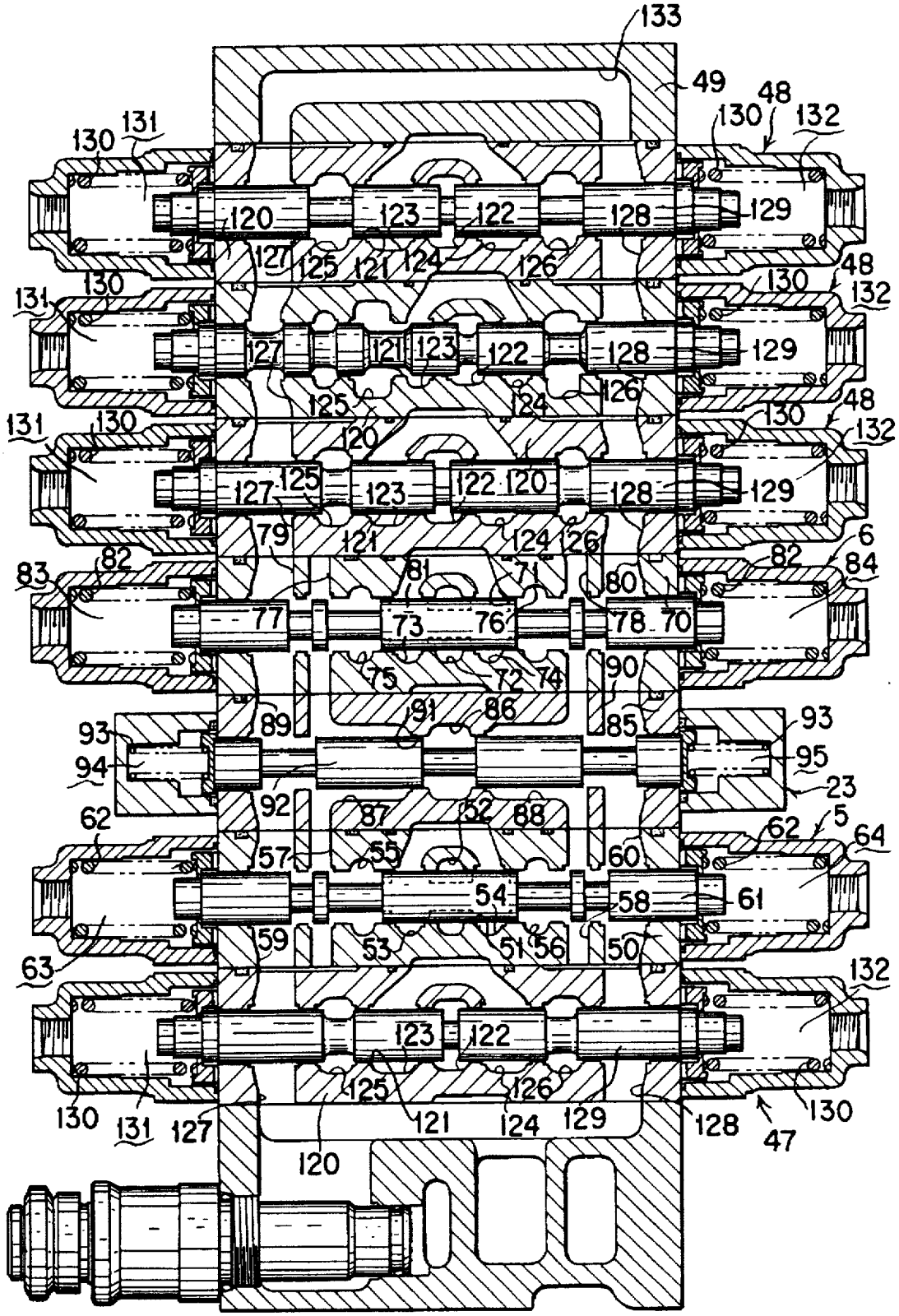
FIG. 5 is a section taken along line V—V of FIG. 4.

As shown in FIG. 5, the left direction switching valve 5 has a valve block 50. In the valve block 50, a spool bore 51, a pump port 52, first and second load pressure detecting ports 53 and 54, a left rear actuator ports 55, a left forward actuator port 56, a left forward return port 57, a left rear return port 58 and first and second tank ports 59 and 60 opening to the spool bore 51 are formed. In the spool bore 51, a spool 61 is slidably disposed. The spool 61 is held at a neutral position by left and right springs 62, shifted to a backward movement position by a pilot pressurized fluid supplied to a left pressure receiving chamber 63 at a left end side, and shifted to a forward movement position by a pilot pressurized fluid supplied to a right pressure receiving chamber 64 at a right end side.

While the spool 61 of the left direction switching valve 5 is held at the neutral position, communications between the pump port 52 and respective of the first and second load pressure detecting ports 53 and 54 are shut off, a communication between the left rear actuator port 55, the left forward return port 57 and the first tank port 59 is established, and a communication between the left forward actuator port 56, the left rear return port 58 and the second tank port 60 is established.

When the spool 61 is in the backward movement position, the pump port 52 is communicated with the left rear actuator port 55 via the second and first load pressure detecting ports 54 and 53, communication between the left forward return port 57 and the first tank port 59 is shut off, and the left forward actuator port 56 is communicated with the left rear return port 58. By this, pressurized fluid is supplied to the backward movement port 3*a* of the left hydraulic motor 3 for traveling to cause revolution of the left hydraulic motor 3 for traveling in the backward movement side.

When the spool 61 is in the forward movement position, the pump port 52 is communicated with the left forward actuator port 56 via the first and second load pressure detecting ports 53 and 54, communication between the left rear return port 58 and the second tank port 60 is shut off, and the left rear actuator port 55 is communicated with the left forward return port 57. By this, the pressurized fluid is supplied to the forward movement port 3*b* of the left hydraulic motor 3 for traveling to cause revolution of the left hydraulic motor 3 for traveling in the forward movement side.

As shown in FIG. 5, the right direction switching valve 6 has a valve block 70. In the valve block 70, a spool bore 71, a pump port 72, first and second load pressure detecting ports 73 and 74, a right forward actuator ports 75, a right rear actuator port 76, a right rear return port 77, a right forward return port 78 and first and second tank ports 79 and 80 opening to the spool bore 71 are formed. In the spool bore 71, a spool 81 is slidably disposed. The spool 81 is held at a neutral position by left and right springs 82, shifted to a backward movement position by a pilot pressurized fluid supplied to a left pressure receiving chamber 83 at a left end side, and shifted to a forward movement position by a pilot pressurized fluid supplied to a right pressure receiving chamber 84 at a right end side.

While the spool 81 of the right direction switching valve 5 is held at the neutral position, communications between the pump port 72 and respective of the first and second load pressure detecting ports 73 and 74 are shut off, a communication between the right forward actuator port 75, the right rear return port 77 and the first tank port 79 is established, and a communication between the right rear actuator port 76, the right forward return port 78 and the second tank port 80 is established.

When the spool 81 is in the forward movement position, the pump port 72 is communicated with the right forward actuator port 75 via the second and first load pressure detecting ports 74 and 73, communication between the right rear return port 77 and the first tank port 79 is shut off, and the right rear actuator port 76 is communicated with the right forward return port 78 is communicated. By this, pressurized fluid is supplied to the forward movement port 4*b* of the right hydraulic motor 4 for traveling to cause revolution of the right hydraulic motor 4 for traveling in the forward movement side.

When the spool 81 is in the forward movement position, the pump port 72 is communicated with the right rear actuator port 76 via the first and second load pressure detecting ports 73 and 74, communication between the right forward return port 78 and the second tank port 80 is shut off, and the right forward actuator port 75 is communicated with the right rear return port 77. By this, the pressurized fluid is supplied to the backward movement port 4*a* of the right hydraulic motor 4 for traveling to cause revolution of the right hydraulic motor 4 for traveling in the backward movement side.

Namely, the left direction switching valve 5 and the right direction switching valve 6 are the same configurations.

However, the left and right hydraulic motors 3 and 4 for traveling are connected opposite in left and right. When each spool 61 and 81 is shifted in the same direction toward right or left, the left and right hydraulic motors 3 and 4 for traveling are driven to cause revolution in opposite directions. When each spool 61 and 81 is shifted in the opposite directions toward right and left, the left and right hydraulic motors 3 and 4 for traveling are driven to cause revolution in the same direction.

As shown in FIG. 5, the switching valve 23 has a valve block 85. In the valve block 85, a spool bore 91, and a primary port 86, first and second drain ports 87 and 88 and first and second tank ports 89 and 90 opening to the spool bore 91 are formed. Then, a spool 92 inserted into the spool bore 91 is held at a neutral position by left and right springs 93. Then, by the pressurized fluid in the left pressure receiving chamber 94 provided at the left end side, the spool is shifted to a right position, and, by the pressurized fluid in the right pressure receiving chamber 95 provided at the right end side, the spool is shifted to a left position.

While the spool 92 of the switching valve 23 is in the neutral position, the primary port 86 is shut off, communication between the first drain port 87 and the first tank port 89 is established, and communication between the second drain port 88 and the second tank port 90 is established.

When the spool 92 is in the right position, communication is established between the primary port 86 and the second drain port 88, and communication between the second drain port 88 and the second tank port 90 is shut off.

When the spool 92 is in the left position, communication is established between the primary port 86 and the first drain port 87, and communication between the first drain port 87 and the first tank port 89 is shut off.

The first drain port 87 opens at both junction surfaces of the valve block 85 to communicate with the left forward return port 57 opening to the junction surface of the valve block 50 of the left direction switching valve 5, and to communicate with the right rear return port 77 opening to the junction surface of the valve block 70 of the right direction switching valve 6. On the other hand, the second drain port 88 opens at junction surfaces at both sides of the valve block 85 to communicate with the left rear return port 58 opening to the junction surface of the valve block 50 of the left direction switching valve 5 and with the right forward return port 78 opening to the junction surface of the valve block 70 of the right direction switching valve 6. Also, the first and second tank ports 89 and 90 open at both junction surfaces at both sides of the valve block 85 to communicate with the first and second tank ports 59, 79 and 60, 80 opening to respective junction surfaces of the valve blocks 50 and 70 of the left and right direction switching valves 5 and 6.

Figure 6:
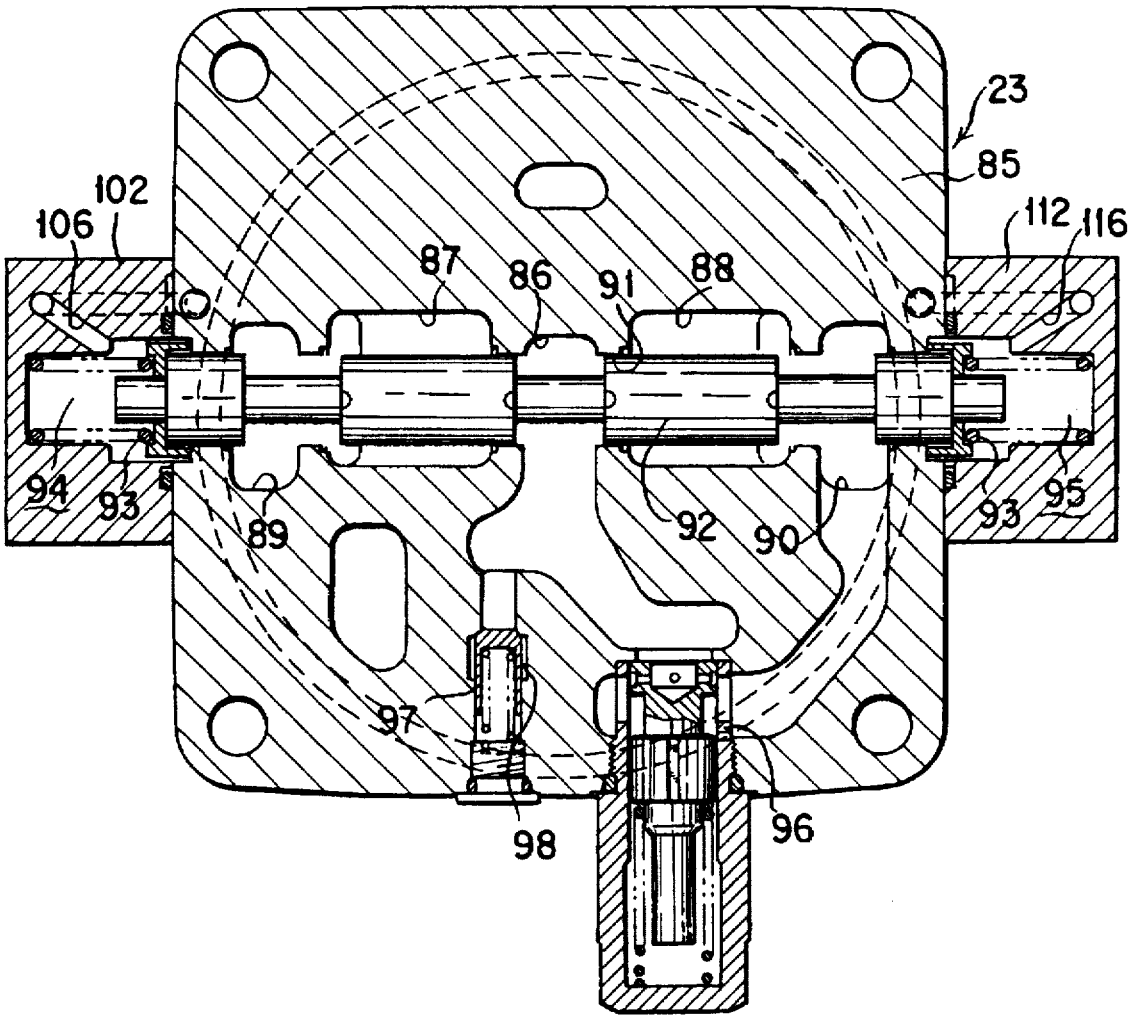
FIG. 6 is a section taken along line VI—VI of FIG. 3.

As shown in FIG. 6, the primary port 86 is communicated with the second tank port 90 via a relief valve 96 for compensation of back pressure, and with a pair of suction ports 98 (only one is shown for the purpose of illustration) via a pair of check valves 97 (only one is shown for the purpose of illustration). Each of these suction ports 98 is communicated with the pump ports 52 and 72 of the left and right direction switching valves 5 and 6.

Figure 7:
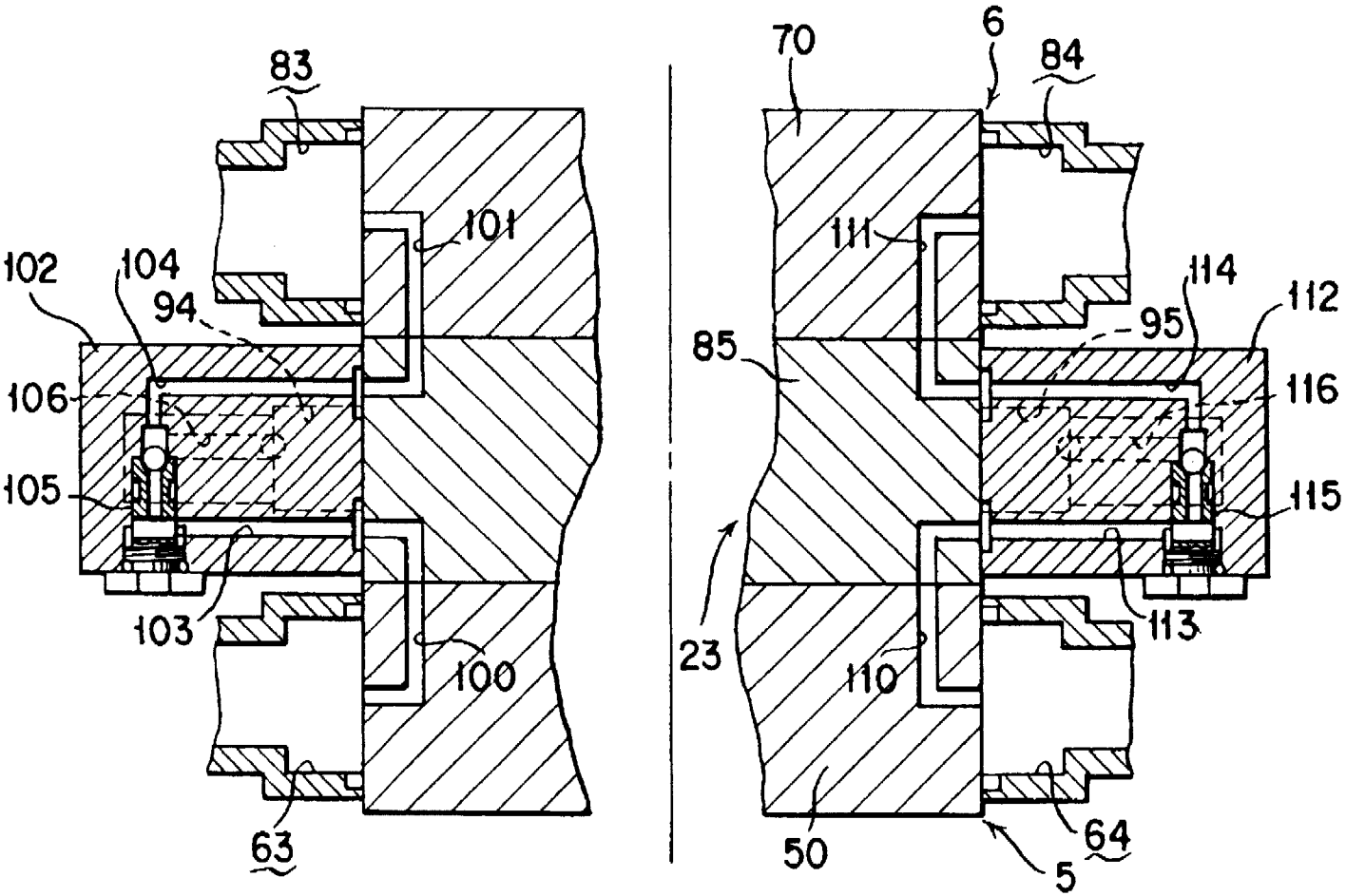
FIG. 7 is a section taken along line VII—VII of FIG. 4.

As shown in FIG. 7, the left pressure receiving chambers 63 and 83 of the left and right direction switching valves 5 and 6 are communicated with the left pressure receiving chamber 94 of the switching valve 23 via a left first passage 100, a left second passage 101 formed in the valve block 85 of the switching valve 23, left third and fourth passages 103 and 104, a left shuttle valve 105 and left passage 106 formed in left spring box 102 for supplying the pressure at the higher pressure side among pressures in respective of left pressure receiving chambers 63 and 83 to the left pressure receiving chamber 94 of the switching valve 23.

As shown in FIG. 7, the right pressure receiving chambers 64 and 84 of the left and right direction switching valves 5 and 6 are communicated with the right pressure receiving chamber 94 of the switching valve 23 via a right first passage 110 and a left second passage 111 formed in the valve block 85 of the switching valve 23, right third and fourth passages 113 and 114, a right shuttle valve 115 and a right passage 116 formed in a right spring box 112 for supplying pressure at the higher pressure side among the pressures in respective right pressure receiving chambers 64 and 84 to the right pressure receiving chamber 95 of the switching valve 23.

Next, operation of the shown embodiment will be discussed.

The pilot pressure is supplied to the right pressure receiving chamber 64 of the left direction switching valve 5 to push the spool 61 toward left to the forward movement position.

By this, the pressurized fluid flowing into the pump port 52 is supplied to the forward movement port **3*b* of the left hydraulic motor 3 for traveling to drive the latter in the forward movement direction. The return fluid from the backward movement port 3*a* flows into the first drain port 87 of the switching valve 23 from the left rear actuator port 55 and the left return port 57** to be recirculated to the tank.

The pilot pressure is supplied to the left pressure receiving chamber 83 of the right direction switching valve 6 to push the spool 81 toward right to the forward movement position.

By this, the pressurized fluid flowing into the pump port 72 is supplied to the forward movement port **4*b* of the right hydraulic motor 4 for traveling to drive the latter in the forward movement direction. The return fluid from the backward movement port 4*a* flows into the second drain port 88 of the switching valve 23 from the right rear actuator port 76 and the right return port 78 to be recirculated to the tank from the second tank port 90**.

The pilot pressure supplied to the right pressure receiving chamber 64 of the left direction switching valve 5 flows into the right pressure receiving chamber 95 of the switching valve 23. In conjunction therewith, the pilot pressure supplied to the left pressure receiving chamber 83 of the right direction switching valve 6 flows into the left pressure receiving chamber 94 of the switching valve 23.

Then, when both pilot pressures are equal to each other, the spool 92 of the switching valve 23 is placed at the neutral position. The return fluid from the left and right hydraulic motors 3 and 4 for traveling recirculates into the tank via the first and second tank ports 89 and 90.

Figure 2:
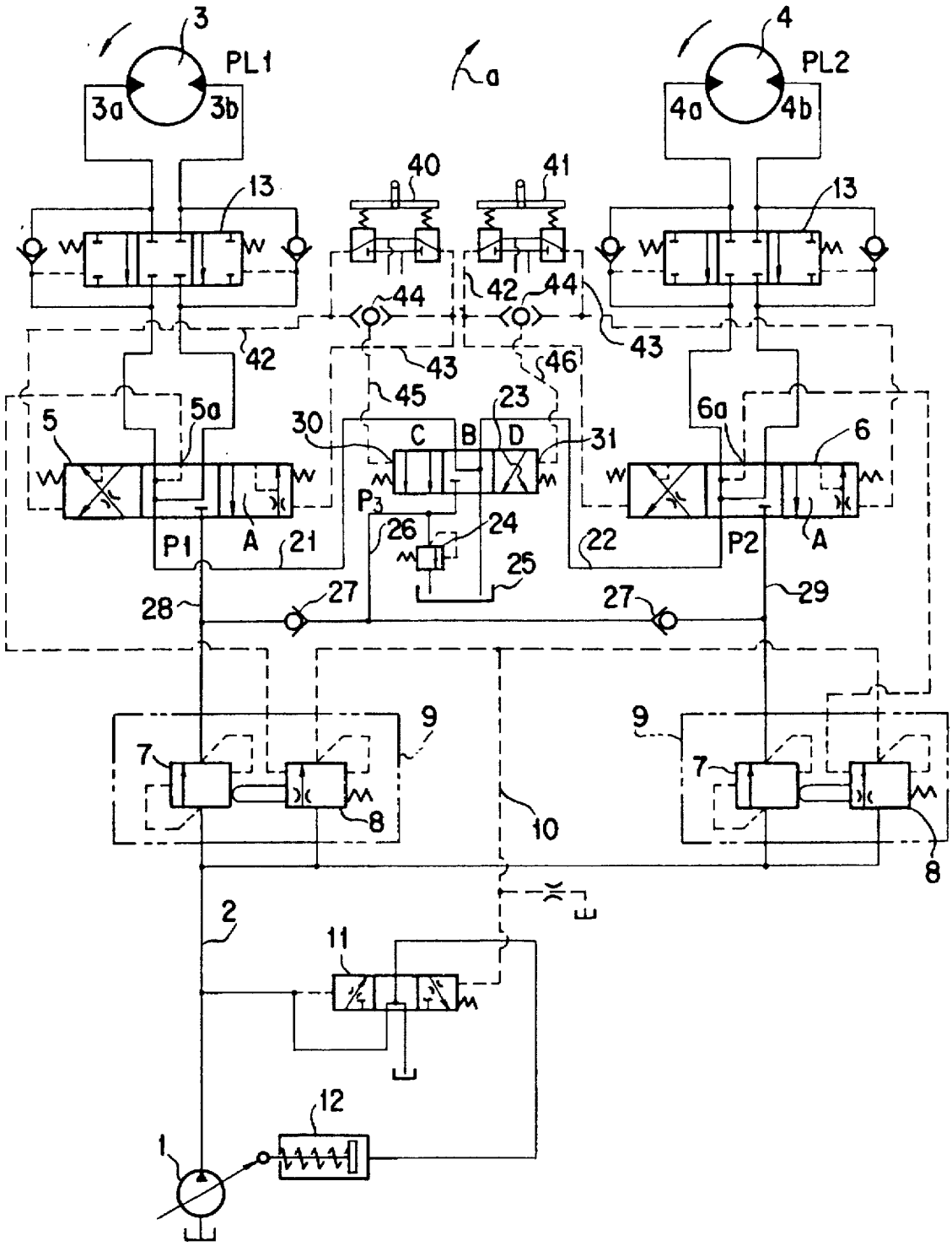
FIG. 2 PRIOR ART
FIG. 2 is an illustration showing another conventional hydraulic circuit for traveling.

When the pilot pressure of the left direction switching valve 5 is higher than the pilot pressure of the right direction switching valve 6, namely, as illustrated in FIG. 2, the left hydraulic motor 3 for traveling relates to the outer side of the turning circle, and the right hydraulic motor 4 for traveling relates to the inner side of the turning circle.

In this case, since the pressure of the right pressure receiving chamber 95 of the switching valve 23 becomes higher than the pressure of the left pressure receiving chamber 94, the spool 92 is pushed toward left to the left position. Then, the first drain port 87 is communicated with the primary port 86.

By this, the return fluid from the left hydraulic motor 3 for traveling flows to the primary port 86, and is returned to the pump port 72 of the right direction switching valve 6 for regeneration of the fluid via the check valve 97 and the suction port 98 with compensation of the back pressure by the relief valve 96.

Accordingly, similar to the prior art shown in FIG. 2, the traveling speed in turning is not lowered.

As shown in FIG. 5, the direction switching valve 47 for turning and respective direction switching valves 48 for the boom, the arm and the bucket are formed with spool bores 121 in valve blocks 120. Pump port 122, first and second load pressure detecting ports 123 and 124 and first and second actuator ports 125 and 126 and first and second tank ports 127 and 128 are open to the spool bores 121. Spools 129 is disposed in the spool bores 121. The spools 129 are placed at neutral positions by left and right springs 130. By the pressurized fluid in the left and right pressure receiving chambers 131 and 132 provided at left and right sides, the spool 129 is shifted to first and second positions. The first and second tank ports 127 and 128 are communicated with the first and second tank ports 59, 79 and 60, 80 of the left and right direction switching valves 5 and 6 and mutually communicate via the fluid bore 133 of the block 49.

As set forth above, with the shown embodiment, the return fluid from the left and right hydraulic motors 3 and 4 for traveling directly flow into the first and second drain ports 87 and 88 of the switching valve 23 from the return ports 57 and 58 of the left and right direction switching valves 5 and 6, and to flow into the primary port 86 or into the tank. Thus, it is not necessary to connect the left and right direction switching valves 5 and 6 to the switching valve 23 by piping, and to connect the switching valve 23 to the tank by the piping.

Also, with the shown embodiment, separately from the return ports 57, 58, 77 and 78 and the drain ports 87 and 88, the tank ports 59, 60, 79, 80, 89 and 90 are provided. Therefore, when the direction switching valve for driving other actuator is connected, even when the direction switching valve is operated, the return fluid of the left and right hydraulic motors 3 and 4 for traveling can independently flow out to the tank without influencing for return back pressure of other actuator or to cause regeneration of the fluid.

On the other hand, by the shown embodiment, the switching valve 23 can be switched utilizing the pilot pressure for switching the left and right switching valves 5 and 6. And, piping for introduction of the pilot pressure becomes unnecessary.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

We claim:

1. A hydraulic apparatus for traveling comprising:

a left direction switching valve formed by forming a spool bore having a pump port, an actuator port and a return port in a first valve block, and by disposing a spool within said spool bore for establishing and blocking communication of respective of said ports to another of said ports;

a right direction switching valve formed by forming a spool bore having a pump port, an actuator port and a return port in a second valve block, and by disposing a spool within said spool bore for establishing and blocking communication of respective of said ports to another of said ports;

a switching valve formed by forming a spool bore having a primary port and a drain port in a third valve block, and by disposing a spool within said spool bore for establishing and blocking communication between respective of said ports and another of said ports; and said first and second valve blocks being respectively connected with said third valve block to communicate respective of said return ports and said drain port.

2. A hydraulic apparatus for traveling comprising:

a left direction switching valve formed by forming a spool bore having a pump port, an actuator port and a return port in a first valve block, and by disposing a spool within said spool bore for establishing and blocking communication of respective of said ports to another of said ports;

a right direction switching valve formed by forming a spool bore having a pump port, an actuator port and a return port in a second valve block, and by disposing a spool within said spool bore for establishing and blocking communication of respective of said ports to another of said ports;

a switching valve formed by forming a spool bore having a primary port and a drain port, and a suction port in a third valve block, and by disposing a spool within said spool bore for establishing and blocking communication between respective of said ports and another of said ports, said primary port being communicated with said drain port via a relief valve, and said primary port being communicated with said suction port via a check valve; and said first and second valve blocks being respectively connected with said third valve block to communicate for respective of said return ports and said drain port and to communicate said suction port to respective of said pump ports.

3. A hydraulic apparatus for traveling as set forth in claim 1 or 2, which further comprises a tank port different from said return port in each of said first and second valve blocks, and a tank port different from said drain port in said third valve block, and these tank ports are communicated to each other.

4. A hydraulic apparatus for traveling as set forth in any one of claims 1 or 2, wherein, said spools of said left and right direction switching valves are actuated for switching by the pressurized fluid of the pressure receiving chambers provided at both sides of said spool, and said spool of said switching valve is actuated for switching by the pressurized fluid of the pressure receiving chamber provided at both sides of said spool, and the pressure receiving chambers of said left and right direction switching valves are communicated with said pressure receiving chamber of said switching valve via a shuttle valve.

5. A hydraulic apparatus for traveling comprising:

a left direction switching valve for supplying a pressurized fluid to a left hydraulic motor for traveling comprising, a spool bore having a pump port and two actuator ports and two return ports being formed in a first valve block, and a spool disposed within said spool bore being shifted to a backward movement position, in which said pump port and one of said actuator ports are communicated and the other of said actuator ports and the other of said return ports are communicated, by a pressurized fluid to a left pressure receiving chamber located at a left end side, and to a forward movement position, in which said pump port and said other of the actuator port are communicated and said one of actuator ports and one of said return ports are communicated, by a pressurized fluid to a right pressure receiving chamber at a right end side;

a right direction switching valve for supplying a pressurized fluid to a right hydraulic motor for traveling comprising, a spool bore having a pump port and two actuator ports and two return ports being formed in a second valve block, and a spool disposed within said spool bore being shifted to a forward movement position, in which said pump port and the other of said actuator ports are communicated and said one of the actuator ports and one of said return ports are communicated, by a pressurized fluid to a left pressure receiving chamber located at a left end side, and to a backward movement position, in which said pump port and said one of the actuator ports are communicated and said other of the actuator ports and said other of the return ports are communicated, by a pressurized fluid to a right pressure receiving chamber at a right end side;

a switching valve being formed with a spool bore having a primary port and first and second drain ports in a third valve block, and a spool disposed in said spool bore being shifted to a right position, in which said primary port and said second drain port are communicated by a pressurized fluid to a left pressure receiving chamber positioned at a left end side, and to a left position, in which said primary port and said first drain port are communicated by a pressurized fluid to a right pressure receiving chamber at a right end side; and wherein:

said first and second valve blocks being connected with said third valve block for communicating said first drain port with respective one of return ports and communicating said second drain port with respective other of the return ports; and said left pressure receiving chambers of said left and right direction switching valves being communicated with said left pressure receiving chamber of said switching valve via a left shuttle valve and said right pressure chambers of said left and right direction switching valves being communicated with said right pressure receiving chamber of said switching valve via a right shuttle valve.

* * * * *